US012006109B2

(12) United States Patent
Lempert

(10) Patent No.: US 12,006,109 B2
(45) **Date of Patent: *Jun. 11, 2024**

(54) SYSTEM FOR PUSH AND TURN CHILD SAFETY CONTAINER WITH FINGER GRIPS

(71) Applicant: GROWPACK LLC, Denver, CO (US)

(72) Inventor: Michael S. Lempert, Commerce City, CO (US)

(73) Assignee: GROWPACK LLC, Denver, CO (US)

( * ) Notice: Subject to any disclaimer, the term of this patent is extended or adjusted under 35 U.S.C. 154(b) by 43 days.

This patent is subject to a terminal disclaimer.

(21) Appl. No.: 17/899,344

(22) Filed: Aug. 30, 2022

(65) Prior Publication Data

US 2023/0061687 A1 Mar. 2, 2023

Related U.S. Application Data

(63) Continuation of application No. 17/838,107, filed on Jun. 10, 2022, which is a continuation of application (Continued)

(51) Int. Cl.
*B65D 50/04* (2006.01)

(52) U.S. Cl.
CPC ..... *B65D 50/041* (2013.01)

(58) Field of Classification Search
CPC ..... B65D 2519/00497; B65D 2519/00925; B65D 81/3823; B65D 81/127;

(Continued)

(56) References Cited

U.S. PATENT DOCUMENTS 4,069,935 A 1/1978 Hampel
5,027,844 A 7/1991 Forsythe (Continued)

FOREIGN PATENT DOCUMENTS

KR 10-2015-0143387 12/2015

OTHER PUBLICATIONS

PCT International Search Report for International Application PCT/2022/019494, search report data of mailing Jun. 23, 2022 (Jun. 23, 2022).

*Primary Examiner* — Shawn M Braden
(74) *Attorney, Agent, or Firm* — Daniel W. Roberts; Law Offices of Daniel W. Roberts, LLC

(57) ABSTRACT

Provided is a system a push and turn child safety container with finger indents. This improved safety container is characterized by a outer body having a first circular element bounded by a first circumferential wall having an inward lip at the distal end. An inner surface of the first circular element providing a plurality of first ridges. Nested within the outer body is an inner body characterized by a second circular element bounded by a second circumferential wall extending normally away from the second circular element. The inner surface of the second circumferential wall having first threads; and an outer surface of the second circular element having a plurality of second ridges for temporarily engaging with the first ridges of the first circular element. The safety container has a screw element screw element characterized by a circular first element having an outer circumferential wall having at least one indent structured and arranged to receive a user's finger tips. The indent provides abutment surfaces for the user's finger tips. A threaded collar extends normally from the circular first element below the indents and is structured and arranged to be disposed within the inner body and engage the first threads of the inner surface of the second circumferential wall to temporarily bind the screw element with the inner body.

20 Claims, 10 Drawing Sheets

Related U.S. Application Data

No. 17/204,818, filed on Mar. 17, 2021, now Pat. No. 11,396,409.

(58) Field of Classification Search

CPC ..... B65D 2215/02; B65D 2215/00; B65D 81/3813; B65D 50/041

See application file for complete search history.

(56) References Cited

U.S. PATENT DOCUMENTS

| | | | |
|---|---|---|---|
| 9,045,265 | B2 | 6/2015 | Adamczak |
| D781,151 | S | 3/2017 | Lerman |
| 2005/0150857 | A1 | 7/2005 | Brozell et al. |
| 2008/0251531 | A1 | 10/2008 | Coe |
| 2009/0032486 | A1 | 2/2009 | Brozell et al. |
| 2009/0127157 | A1 | 5/2009 | Costa |
| 2015/0298866 | A1 | 10/2015 | Hagen |
| 2016/0030285 | A1 | 2/2016 | Miceli et al. |
| 2016/0176590 | A1 | 6/2016 | Prater |
| 2018/0346208 | A1 | 12/2018 | Painchaud |
| 2019/0308778 | A1* | 10/2019 | Gift ..... B29C 37/0085 |
| 2019/0344938 | A1 | 11/2019 | Clariant |
| 2019/0367225 | A1 | 12/2019 | Aryanpanah |
| 2020/0148436 | A1 | 5/2020 | Brown |

* cited by examiner

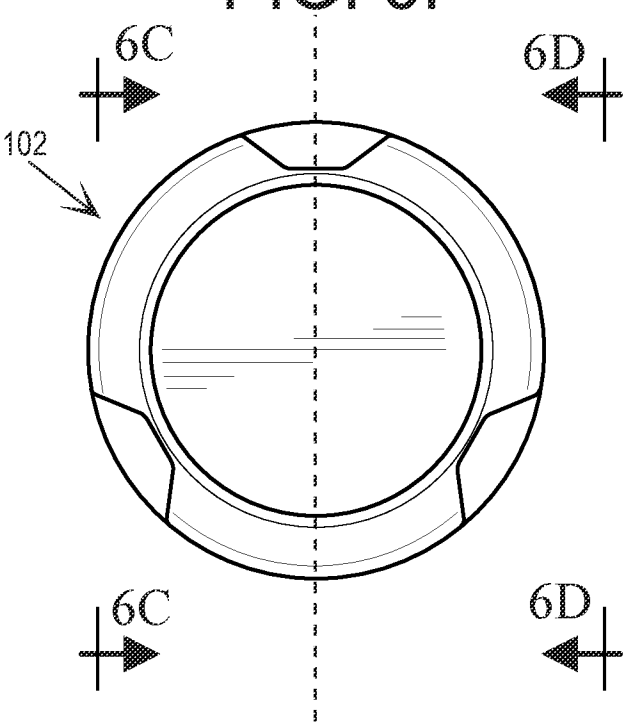
FIG. 5F
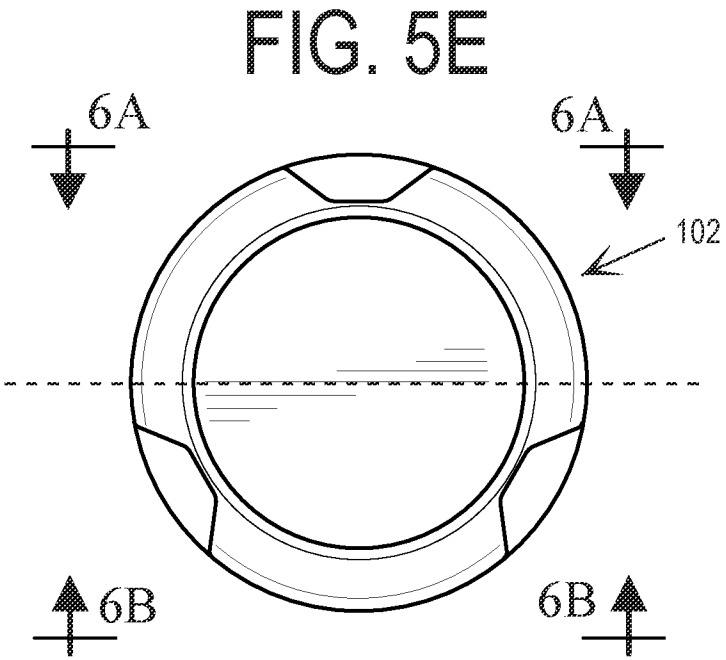
FIG. 5E
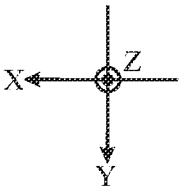

SYSTEM FOR PUSH AND TURN CHILD SAFETY CONTAINER WITH FINGER GRIPS

CROSS REFERENCE TO RELATED APPLICATIONS

The present application is a continuation of U.S. patent application Ser. No. 17/838,107 filed Jun. 10, 2022, now U.S. Pat. No. 11,958,665, and incorporated herein by reference, which is in turn a continuation of U.S. patent application Ser. No. 17/204,818 filed Mar. 3, 2021 and now U.S. Pat. No. 11,396,409 issued on Jul. 26, 2022, and incorporated herein by reference. This continuing application claims the benefit of the filing date of U.S. patent application Ser. No. 17/204,818, filed Mar. 3, 2022.

FIELD OF THE INVENTION

The present invention relates generally to child safety container systems, and more specifically to push and turn child resistant container type enclosures.

BACKGROUND

Child safety container systems are used on containers that store substances which may be potentially dangerous, harmful or otherwise undesirable for children. The nature of such substances is quite wide ranging, including such things as medications, cleaning products, poisons, gas, bleach, and many others. They may also include substances which are deemed appropriate for adults, but not so for children, such as cosmetics, alcohol, and medicinal or recreational products.

The central theme of such child safety container systems is clear—prevent a child from opening the container while permitting an adult to do so at will. Often this simple premise can be frustrating, for many adults suffer from arthritis or ailments of stiffness and weakness such that it may be physically challenging for an adult to open the safety container. More simply stated, making the container difficult for a child often makes it difficult for the elderly or infirm.

One form of such safety containers is recognized as the push and turn enclosure or system. Essentially the user must push the cap and bottom together with sufficient force so as to engage some form of internal locking structure such that rotation of the cap and container relative to each other translates to rotation of the interlocking threads permitting the cap and container to be unscrewed from one another.

The prior art is riddled with an impressive array of such devices. Some, but certainly not all examples of such systems can be found in US Patent Publication 2009/0032486 to Brozell et al. for TWO-PIECE CHILD-RESISTANT CLOSURE AND PACKAGE, US Patent Publication 2016/0030285 to Miceli et al. for CHILD PROOF CLOSURE, U.S. Pat. No. 10,414,560 to Aryanpanah et al. for CHILDPROOF JAR.

These references have been identified as a specific representation set of such child safety container systems because they share a common thread, and shortcoming. In an effort to assist an adult in manipulating the cap each of these references teaches a plurality of ridges about the outer wall. In other words, the outer wall of the cap is highly textured, and uniformly so. This is clearly to provide a non-slip surface that may be easily grasped and held during the press and turn operation required to open the container. Helpful to the grasping hands of an adult, these ridges are equally helpful to the hands of a child.

In contrast to these device, US Patent Publication 2015/0298866 to Hagen for CONTAINER, and Design Patent D781,151 to Lerman for JAR, appear to go too far in the other direction by providing an entirely smooth outer surface wall. While indeed avoiding the potentially helpful outer grasping surface of the above references, these smooth walled alternatives may go too far and once again present a significant dexterity challenge to some adults.

Hence there is a need for a method and system that is capable of overcoming one or more of the above identified challenges.

SUMMARY OF THE INVENTION

Our invention solves the problems of the prior art by providing a novel child safety container for push and turn enclosures with at least one finger grip.

In particular, and by way of example only, according to at least one embodiment, provided is a push and turn child safety container including: an outer body characterized by: a first circular element bounded by a first circumferential wall extending normally away from the first circular element for a first distance, the distal end of the first circumferential wall having an inward lip; an inner surface of the first circular element providing a plurality of first ridges; an innerbody characterized by: a second circular element bounded by a second circumferential wall extending normally away from the second circular element a second distance less than the first distance; an inner surface of the second circumferential wall having first threads; and an outer surface of the second circular element having a plurality of second ridges for temporarily engaging with the first ridges of the first circular element; wherein the inner body is structured and arranged to nest within the outer body and be retained by the inward lip, the inner body freely rotating within the outer body below the lip when the first ridges are not engaged with the second ridges; and a screw element screw element characterized by: a circular first element having a substantially smooth outer circumferential wall having at least one indent providing an abutment surface to receive a substantial portion of a user's fingertip, the circumferential wall; and a threaded collar extending normally from the circular first element below the least one indent, the threaded collar structured and arranged to be disposed within the inner body and engage the first threads of the inner surface of the second circumferential wall to temporarily bind the screw element with the inner body, the threaded collar defining at least a portion of a storage space for the safety container.

In yet another embodiment, provided is a push and turn child safety container including: an outer body characterized by: a first circular element bounded by a first circumferential wall extending normally away from the first circular element for a first distance, the distal end of the first circumferential wall having a retainer; an inner surface of the first circular element providing a plurality first grippers; an inner body characterized by: a second circular element bounded by a second circumferential wall extending normally away from the second circular element a second distance less than the first distance; an inner surface of the second circumferential wall having a first screw threads; and an outer surface of the second circular element having a plurality of second grippers for temporarily engaging with the first grippers of the first circular element; wherein the inner body structured and arranged to nest within the outer body and be retained by the retainer, the inner body freely rotating within the outer body below the retainer when the first grippers are not engaged with the second grippers; and a screw element characterized by: a circular first element having a substantially smooth outer circumferential wall having at least one indent providing an abutment surface to receive a substantial portion of a user's fingertip, the circumferential wall; and a threaded circular wall extending normally from a circular first element below the at least one indents, the threaded collar structured and arranged to be disposed within the inner body and engage the first threads of the inner surface of the second circumferential wall to temporarily bind the screw element with the inner body.

For yet another embodiment, provided is a screw element with finger grips for a push and turn child safety container having an outer body having a first circular element bounded by a first circumferential wall extending normally away from the first circular element for a first distance, the distal end of the first outer wall having a retainer with an inner body having a second circular element bounded by a second circumferential wall extending normally away from the second circular element a second distance less than the first distance with an inner surface of the second circumferential wall having a first screw thread, the inner body nested with in the outer body and retained by the retainer, including: a screw element characterized by: a circular first element having a substantially smooth outer circumferential wall having at least one indent structured and arranged to receive a user's finger, the least one indent providing an abutment surface to receive a substantial portion of a user's fingertip, the circumferential wall sections being substantially smooth; and a threaded circular wall extending normally from a circular first element below the least one indent, the threaded collar structured and arranged to be disposed within the inner body and engage the first threads of the inner surface of the second circumferential wall to temporarily bind the screw element with the inner body, the threaded collar defining at least a portion of a storage space for the safety container.

DETAILED DESCRIPTION

Before proceeding with the detailed description, it is to be appreciated that the present teaching is by way of example only, not by limitation. The concepts herein are not limited to use or application with a specific child safety system with push and turn resistant enclosure. Thus, although the instrumentalities described herein are for the convenience of explanation shown and described with respect to exemplary embodiments, it will be understood and appreciated that the principles herein may be applied equally in other types of systems involving push and turn enclosure systems.

This invention is described with respect to preferred embodiments in the following description with reference to the Figures, in which like numbers represent the same or similar elements. Further, with respect to the numbering of the same or similar elements, it will be appreciated that the leading values identify the Figure in which the element is first identified and described, e.g., element 100 first appears in FIG. 1.

Turning now to the figures, and more specifically FIG. 1, there is shown a safety container with at least one finger grip 100, hereinafter SCFG 100, in accordance with at least one embodiment of the present invention. For at least one embodiment, SCFG 100 comprises a screw element 102 that is rotationally disposed into an outer body 104 (shown), having a nested inner body (not shown in FIG. 1).

Figure 1:
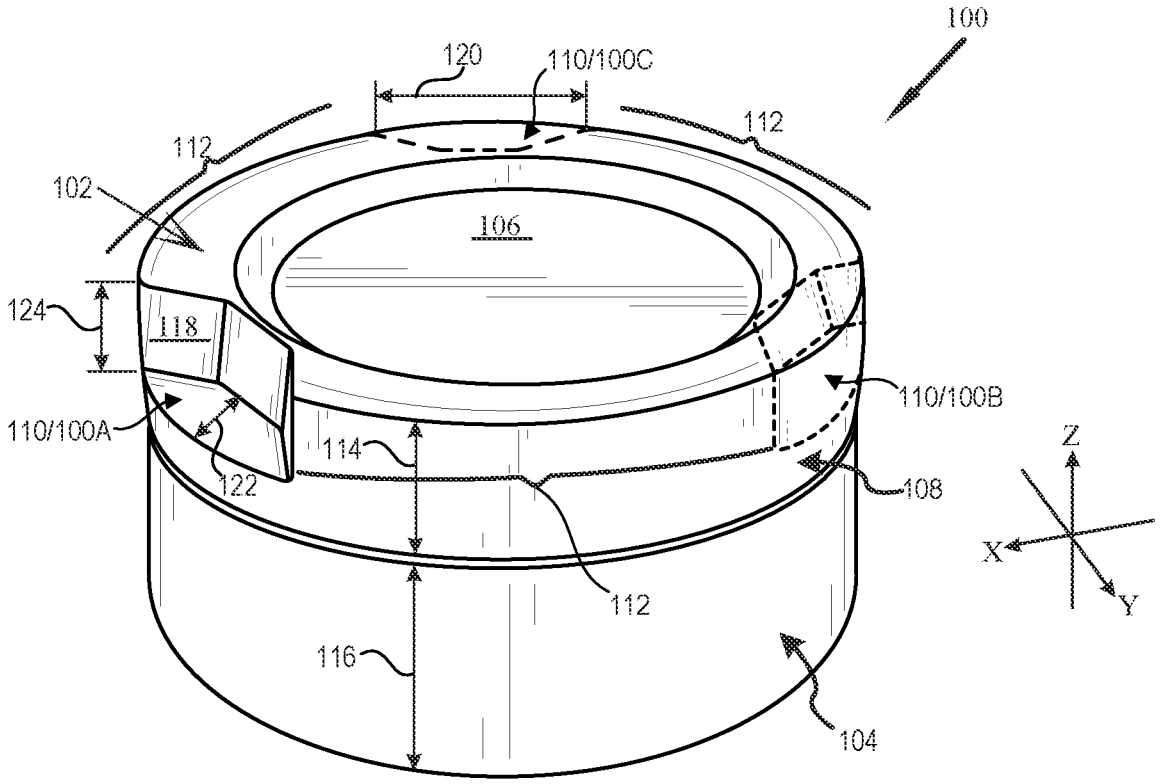
FIG. 1 is a bottom perspective view of safety container with finger grips in accordance with at least one embodiment of the present invention.

To facilitate the description of systems and methods for embodiments of SCFG 100, the orientation of SCFG 100 as presented in the figures is referenced to the coordinate system with three axes orthogonal to one another as shown in FIG. 1. The axes intersect mutually at the origin of the coordinate system, which is chosen to be the center of SCFG 100, however the axes shown in all figures are offset from their actual locations for clarity and ease of illustration.

As may be appreciated from the perspective view of FIG. 1, the screw element has a circular first element 106 having an outer circumferential wall 108. Disposed within this outer circumferential wall 108 is at least one indents 110 structured and arranged to receive a user's finger tip. It is to be appreciated that each indent 110 is a finger grip, specifically a fingertip grip.

For at least one embodiment, there is one indent 110, e.g., intent 100A, disposed in the otherwise substantially smooth/slick circumferential wall 108. This one indent 110 may be engaged by a user's thumb, first finger, second finger, or other finger and provided a gripping point on the otherwise substantially smooth outer circumferential wall 108.

For yet another embodiment there are at least two indents 110, e.g., intent 110A as identified above, and indent 110B shown in dotted relief—each structured and arranged to receive a user's finger tips. For one embodiment, these two indents 110 (100A and 100B) may be equally disposed on opposite sides of the first element 106—with the center of each indent being about 180 degrees from each other. For yet another embodiment, these two indents 110 (100A and 100B) may be disposed such that their centers are substantially less than 180 in a first direction and more than 180 degrees in an opposite second direction. In other words, for at least one embodiment, the two indents 110 are disposed less than 180 degrees apart about the circumferential wall 108, the circumferential wall 108 being substantially slick between the at least two indents 110.

For yet another embodiment, there are a plurality of indents 110 disposed within the outer circumferential wall 108. However, for at least one embodiment it will be understood and appreciated that collectively the wall sections 112 account for no less than one-third of the circumference of the outer circumferential wall 108. For still yet another embodiment, it will be understood and appreciated that collectively the wall sections 112 account for no less than one-half of the circumference of the outer circumferential wall 108. As is shown in FIG. 1, for at least one embodiment having a plurality of indents 110, there are at least three indents 100, e.g., indent 110A, indent 110B show in dotted relief, and 110C shown in yet a different dotted relief.

Moreover, it will be understood and appreciated that the indents 110 serve as finger grips between wall sections 112 that are otherwise smooth or slick. As is further described below, these indents 110 should not be confused or equated to be intervening channels between ridges—such as may be established by a series of half rod elements in parallel alignment to define the outer wall or surface of a cap. More specifically, it will be an understood and appreciated advantage of the present invention, that at least half, if not a majority, of the outer circumferential wall 108—i.e. the wall section(s) 112, is/are smooth.

For at least one embodiment, the wall section(s) 112, is/are slick. For an embodiment with only one indent 110, e.g., just indent 110A, there is essentially only one wall section 112—the outer circumferential wall 108 being essentially continuous from one side of the indent 110A. Being smooth/slick, it is difficult to grasp the wall section(s) 112 with sufficient force to unscrew the first element 106 from the outer body 104. This difficulty is overcome by the adult user, realizing that the indents 110 are indeed provided as finger grips, structured and arranged to receive a substantial portion of a fingertip or thumb tip.

It will be appreciated that for at least one embodiment the outer circumferential wall 108 has a first height 114. It will also be appreciated that the outer body 104 has a second height 116, and that the second height 116 is at least about one-and-a-half (1.5) times greater the first height 114. For at least one embodiment, the second height 116 is at least twice the first height 114. Moreover, the second height 116 is pre-selected to facilitate easy grasping with or without an external roughing or gripping element being provided upon the outside of the outer body 104.

In contrast, the screw element 102 has a first height 114 sufficient to accommodate indents 110, but is also thin enough and provided with smooth wall sections 112 such that it may be challenging to firmly grip and rotate, absent placement of a user's finger and thumb tips within at least one indent 110.

As noted above, the elderly and infirm may have issues with dexterity and hand strength. In contrast to prior art systems that offer texturized, ridged, ribbed or other roughened outer surfaces to increase the opportunity for friction as between the user's fingers and the container, the indents 110 of SCFG 100 provide true abutment surfaces 118, further shown in FIG. 5. In advantageous contrast to those prior art systems striving to offer texturized, ridged, ribbed or other roughened outer surfaces to increase the opportunity for friction with the user's fingers, the abutment surfaces provided by the at least one indent 110 provide advantageous points for applied force and leverage on an otherwise smooth and slick surface.

In other words, the one or more indents 110 receive lateral force from the user's finger tips to assist in rotation of the screw element 102 relative to the outer body 104. This lateral force as provided by the user's finger tips is achieved by each indent 110 being structured and arranged provide abutment surfaces 118 to receive the finger tips (including thumb tip/side) of a typical adult. More specifically, the each provided indent 110 permit a user to push against surfaces to drive rotation as opposed to relying upon friction between the user's fingers and the outer surface to induce rotation.

Moreover, to provide at least one indent 110 with sufficient size and abutment surfaces to receive a user's fingertips, for at least one embodiment each indent 110 has a length 120 of between about 1 centimeter and 2 centimeters, a depth 122 of between about 0.25 centimeters and 0.75 centimeters, and a height 124 of between about 0.25 centimeters and 0.75 centimeters. More specifically, for at least one embodiment each indent 110 is about 1.5 centimeters in length 120, 0.5 centimeters in depth 122 and 0.5 centimeters in height 124.

The disposition of at least one indent 110 in the circumferential wall 108 advantageously permits at least a user's thumb, first or second fingers to easily and naturally engage with the at least one indents 110 and advantageously achieve an improved grip and ease of rotation. As used herein "fingertip" is understood and appreciated to include the thumb tip and or side of the thumb proximate to the thumb tip as well as the tip and/or side proximate to the tip of any finger.

A recent safety test conducted over the dates Jan. 13-24, 2021 in accordance with US 16 CFR § 1700.20 and recorded as Report No.:B-S210134471 by Beide Compliance Laboratory, was performed with fifty (50) children between the ages of 3.5 years and 4.25 years, and fifty (50) adults between the ages of 50 years and 70 years, found that adults were able to quickly realize the advantageous nature of an embodiment of SCFG 100 with three indents 110 to facilitate opening while the children were not.

Indeed, even when the children were shown where and how to place their fingers and thumb, 49 of the 50 were still unable to repeat the demonstrated behavior and open the SCFG 100. Moreover, the physical difference in hand size and differences in developed visual acuity permits improved use of embodiments of SCFG 100 by adults while SCFG 100 still advantageously provides a challenge to children.

Figure 2B:
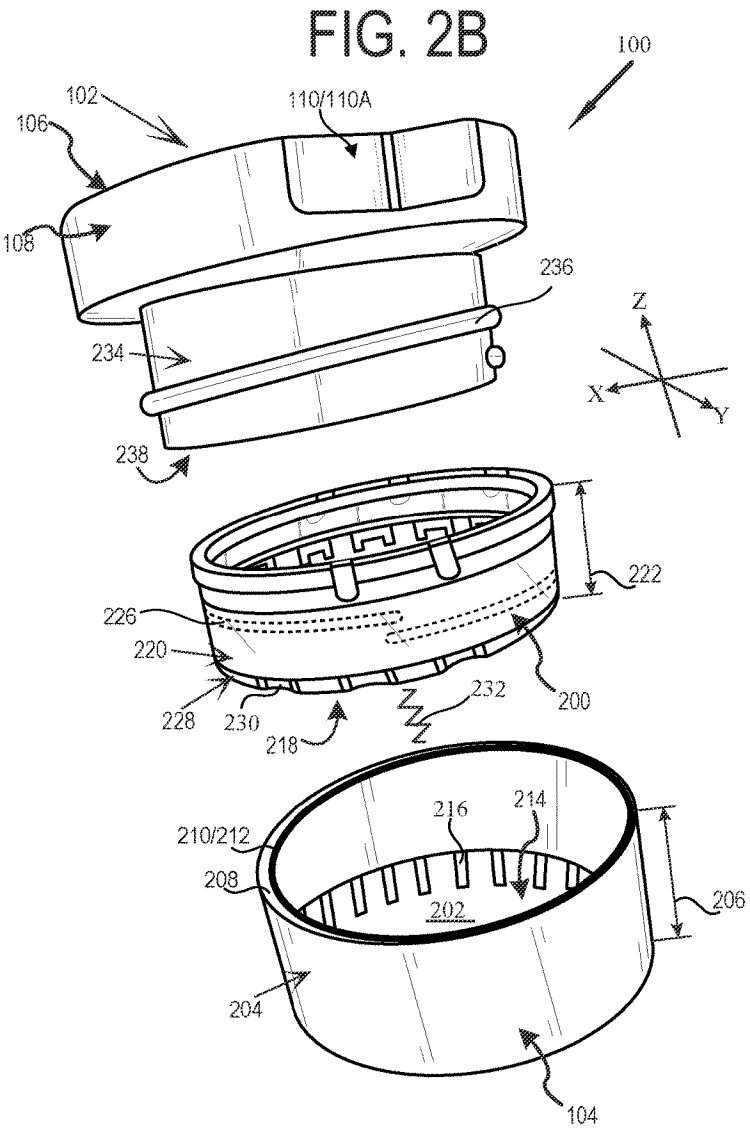
FIG. 2B is yet another perspective side view of the safety container with finger grips from FIG. 1 now opened in accordance with at least one embodiment of the present invention.
Figure 2A:
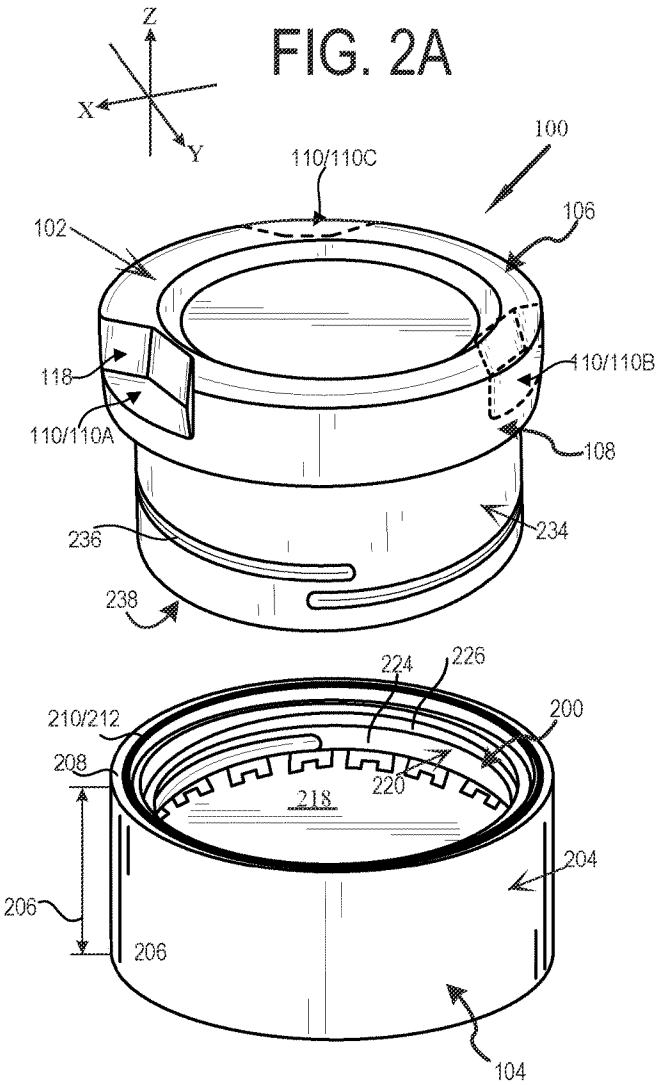
FIG. 2A is a perspective side view of the safety container with finger grips from FIG. 1 now opened in accordance with at least one embodiment of the present invention.

FIG. 2A further illustrates the SCFG 100 of FIG. 1 with the screw element 102 unscrewed such that the outer body 104 and nested inner body 200 may be more fully appreciated. FIG. 2B presents an exploded perspective view of SCFG 100 such that the internal press and lock system as established by the interactions of the screw element 102, the outer body 104 and the inner body 200 may be more fully appreciated.

With respect to FIGS. 2A and 2B it may be appreciated that, for the embodiment as shown, SCFG 100 has an outer body 104 having a first circular element 202 (e.g., a top) bounded by a first circumferential wall 204 extending normally away from the first circular element 202 for a first distance 206. The distal end 208 of the first circumferential wall 204 has a retainer 210. For at least one embodiment, the retainer 210 is an inward lip 212. In varying embodiments, the inward lip 212 may be a contiguous circumferential structure, or subdivided into a plurality of separate inward lip sections.

The inner surface 214 of the first circular element 202 has a plurality of first grippers 216 (See FIG. 2B). Generally, these first grippers 216 are evenly spaced circumferentially and disposed proximate to the circumferential wall 204.

As noted, the SCFG 100 also has an inner body 200 structured and arranged to nest within the outer body 104. The inner body 200 has a second circular element 218 (e.g., a top) bounded by a second circumferential wall 220 extending normally away from the second circular element 218 for a second distance 222 that is less than the first distance 206. The inner surface 224 of the second circumferential wall 220 has first screw threads 226.

The inner body 200 is structured and arranged to nest within the outer body 104 and be retained by the retainer 210. It will further be appreciated that the inner body 200 is structured and arranged to freely rotate within the outer body 104 and below the retainer 210, unless or until a user provides a sufficient press force upon the inner body 200 and the outer body 104 to achieve a temporarily locking or binding relationship as between the inner body 200 and the outer body 104.

This temporary locking or binding relationship is achieved by a temporarily engaging the first grippers 216 with the second grippers 230. Free rotation of the inner body 200 occurs within the outer body 104 and below the retainer 210 when the first grippers 216 are not engaged with the second grippers 230.

For yet another embodiment, the first grippers 216 are a plurality of notches with upward oriented openings, and the second grippers 230 are a plurality of ridges correspondingly sized and spaced to engage with the notches. It will be appreciated that the notches may be formed as structures depressed into the inner surface 214 of the first circular element 202, or defined by walls/ridges rising from the inner surface 214 to define a notch, or plurality of notches as between the raised walls/ridges.

For at least one embodiment, the first grippers 216 are a plurality of raised ridges, and the second grippers 230 are a plurality of notches with downward oriented openings correspondingly sized and spaced to engage with the plurality of ridges. It will be appreciated that the notches may be formed as structures depressed into the outer surface 228 of the second circular element 218, or defined by walls/ridges rising from the outer surface 228 to define a notch, or plurality of notches as between the raised walls/ridges.

Moreover, for at least one embodiment the first grippers 216 and the second grippers 230 are each provided as corresponding ridges which are correspondingly sized and disposed upon the inner surface 214 of the outer body 104 and the outer surface 228 of the inner body 200 to temporarily engage when the inner body 200 and outer body 104 are pressed together. For yet another embodiment the first grippers 216 and the second grippers 230 are substantially paired sets of bumps and indents. For still yet another embodiment the first grippers 216 and the second grippers 230 are correspondingly angled with respect each other to deflect engagement by rotation without a press fitting force applied simultaneously.

For at least one embodiment, at least one spring element 232 may be disposed between the inner body 200 and the outer body 104 to facilitate a non-locking/non-binding state as between the first grippers 216 and the second grippers 230 when the SCFG 100 is at rest. In varying embodiments, spring element 232 may be a coiled spring or a resilient material that may be temporarily compressed when a load is applied such as rubber/foam/bent wire/or the like, or such other element as is deemed appropriate for providing separation between the inner body 200 and the outer body 104 until such time as a user applies appropriate force to induce the temporary engagement as between the first grippers 216 and the second grippers 230. For at least one embodiment, the at least one spring element 232 may be incorporated as part of the inner surface 214 of the outer body 104 and the outer surface 228 of the inner body 200.

Screw element 102 may also be appreciated to have a threaded collar 234 extending normally from the circular first element 106 below the at least one indent 110. The threaded collar 234 provides second screw threads 236 which are structured and arranged to engage with first screw threads 226 of the inner body 200. More specifically, the threaded collar 234 is structured and arranged to be disposed within the inner body 200 and to engage with the first screw threads 226 of the inner surface 224 of the second circumferential wall 220 to temporarily bind the screw element 102 with the inner body 200.

Figure 3:
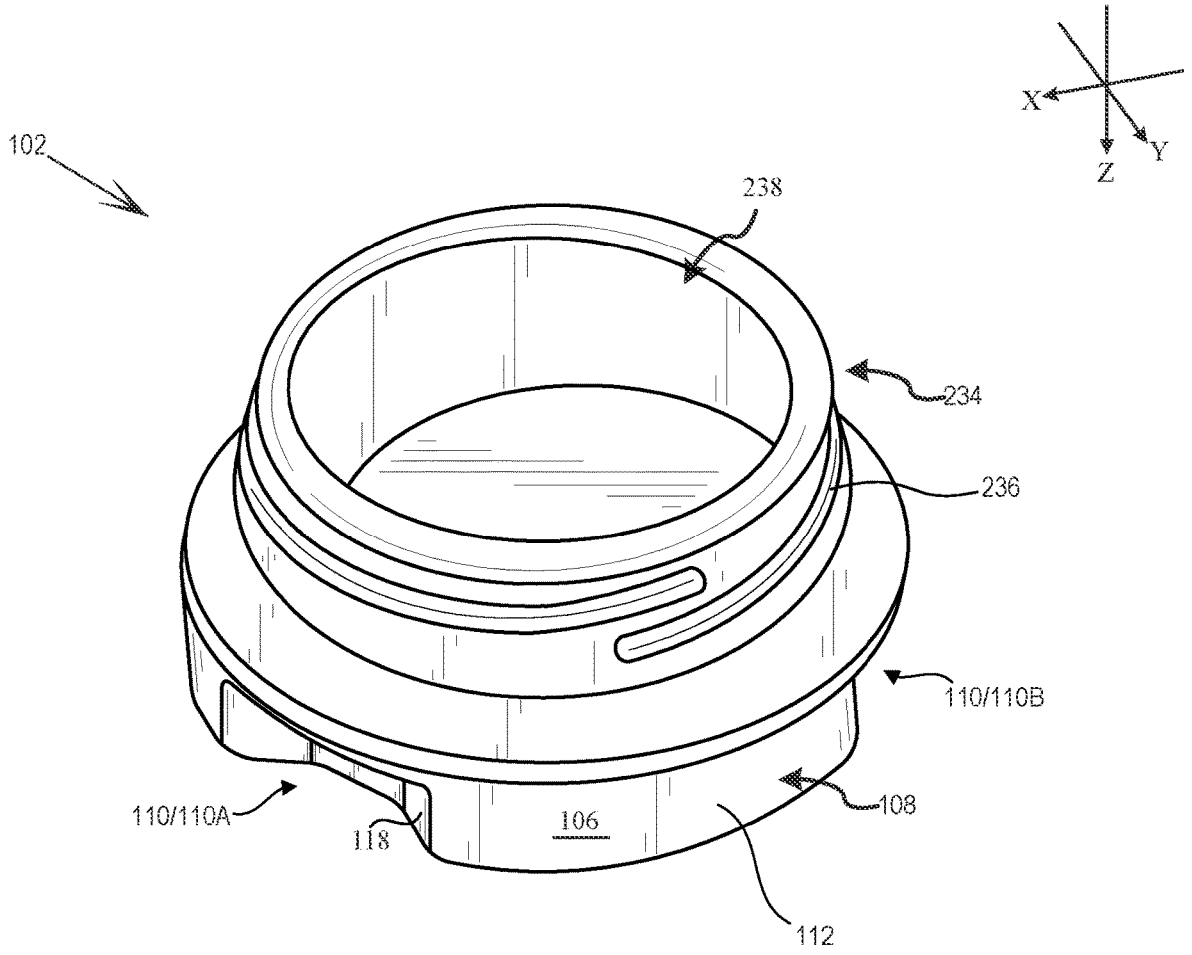
FIG. 3 is a perspective top view of the screw element of the safety container with finger grips from FIG. 1 now opened in accordance with at least one embodiment of the present invention.

FIG. 3 presents an inverted perspective view of the screw element 102. As shown, for at least one embodiment the threaded collar 234 defines a hollow area 238 within the screw element 102, which is understood and appreciated to be at least a portion of the internal storage space provided by SCFG 100. For embodiments where SCFG 100 is intended to safely store and safekeep a cream, cake or other substance in a state that is not prone to flowing within the SCFG 100, the hollow area 238 may be substantially all of the storage area within SCFG 100. In addition, FIG. 3 presents an embodiment where of the at least one indent 110, there are two, indent 110A and indent 110B.

As an embodiment of SCFG 100 may be provided with the screw element 102 providing both the hollow area 238 for storage as well as the intended element to be grasped by a user and twisted while pressed against the nested inner body 200 and outer body 104, the terms of "cap" and "base" have not been specifically used herein so as to avoid a possible misperception of roles provided by these elements. In addition, the terms "top" and "bottom" as used herein are intended as terms of convenience in describing views and orientations, which may be interchanged. For ease of discussion, it may be generally be understood that for at least some embodiments the screw element 102 is essentially a jar—a wide mouth container providing product storage, and nested inner body 200 and outer body 104 provide the cap, or lid.

It is to be understood and appreciated that for at least one embodiment of SCFG 100, the engagement between the threaded collar 234 and the inner body 200 is substantially water tight. For yet another embodiment, one or more vent holes (not shown) may be disposed within the inner body in fluid connection to the outer body 104 such that vapor may escape from the hollow area 238 when the threaded collar 234 is engaged with the inner body 200.

Figure 4:
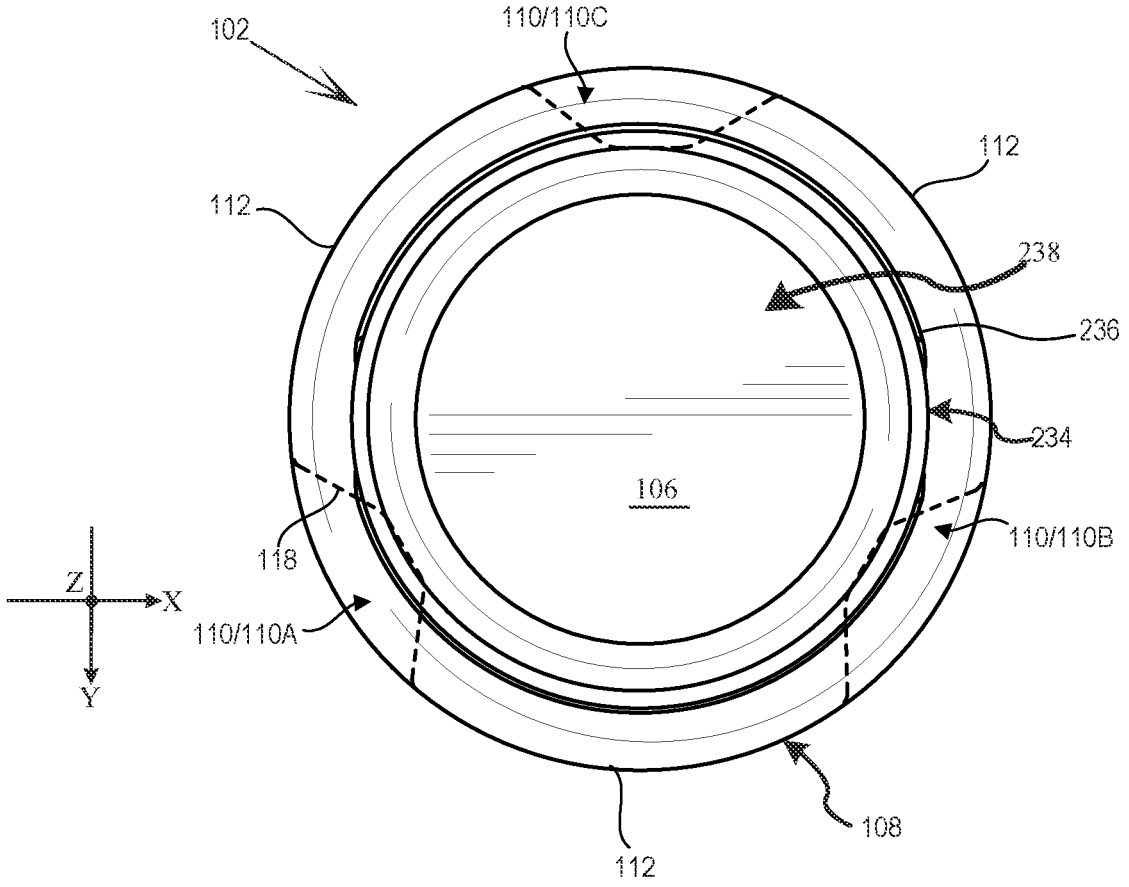
FIG. 4 is top plane view of the screw element shown in FIG. 3 in accordance with at least one embodiment of the present invention.

FIG. 4 is a top view of screw element 102, permitting a further appreciation of the internal hollow area 238 within the threaded collar 234, and the screw element 102 having a true circular first element 106, the at least one indent 110 shown in dotted relief, more specifically indents 110A, 110B and 110C.

Figure 5A:
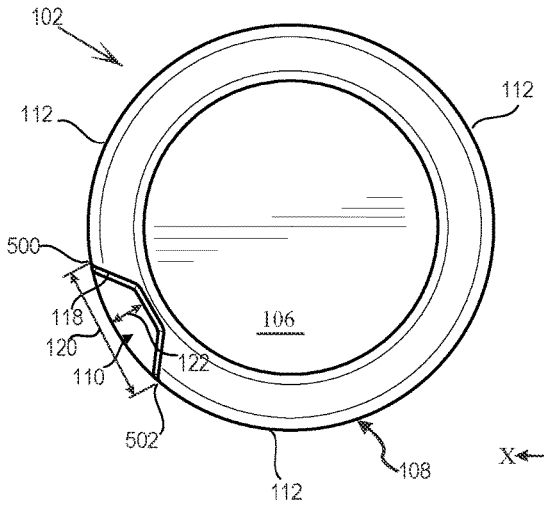
FIGS. 5A, 5B, 5C and 5D are bottom plane view of various embodiments for the screw element of FIG. 1 showing different configurations of at least one indent in accordance with at least one embodiment of the present invention, FIGS. 5E and 5F providing orientation for the side views shown in FIGS. 6A-6B.
Figure 5B:
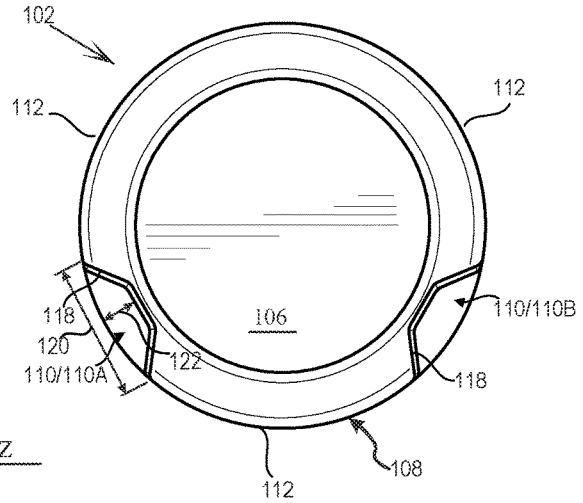
Figure 5B:
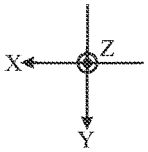
Figure 5C:
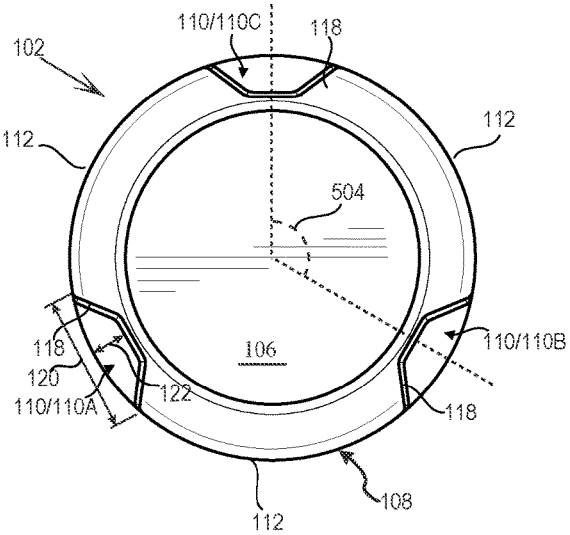

FIGS. 5A, 5B, 5C and 5D show bottom views of screw element 102 for varying embodiments. More specifically, FIG. 5A shows an embodiment with one indent 110 (indent 110A), FIG. 5B shows an embodiment with two indents 110 (indents 110A and 110B), FIG. 5C shows an embodiment with three indents (indents 110A, 110B and 110C), and FIG. 5C shows an embodiment with four indents (110A, 110B, 110C and 110D). For each embodiment, it is again appreciate appreciated that first element 106 is circular and each provided indent 110 provides abutment surfaces 118 structured and arranged to receive a substantial portion of a user's fingertip(s).

In FIG. 5A, the essentially continuous nature of the outer wall 112 may also be appreciated from a first edge 500 of the indent 110 around the top to the second edge 502 of the indent 110. In FIG. 5B, the two indents 110A, 110B are shown disposed unbalanced, which is to say that they are not directly across from one another.

In FIG. 5C it may be appreciated that for an embodiment providing a plurality of indents 110, the indents may be equally spaced about the circumferential wall 108. More specifically, for at least one embodiment with three indents 110 established within the circular first element 106 of screw element 102, each indent 110 is at about 1200 (one hundred twenty degree) increments 504 about the circumferential wall 108. Such substantially equal spacing may of course be applied to an embodiment of screw element 102 presenting two (2) indents 110, such that the indents are equally spaced at about 180° (one hundred eighty degrees).

In addition, as originally presented with respect to the description of FIG. 1 the relative length 120 and depth 122 of the indents 110 may also be further appreciated in FIGS. 5A-5D. To reiterate, to provide at least one indent 110 with sufficient size and abutment surfaces to receive a user's finger tips, for at least one embodiment each indent 110 has a length 120 of between about 1 centimeter and 2 centimeters, a depth 122 of between about 0.25 centimeters and 0.75 centimeters. More specifically, for at least one embodiment each indent is about 1.5 centimeters in length 120 and about 0.5 centimeters in depth 122.

Figure 5D:
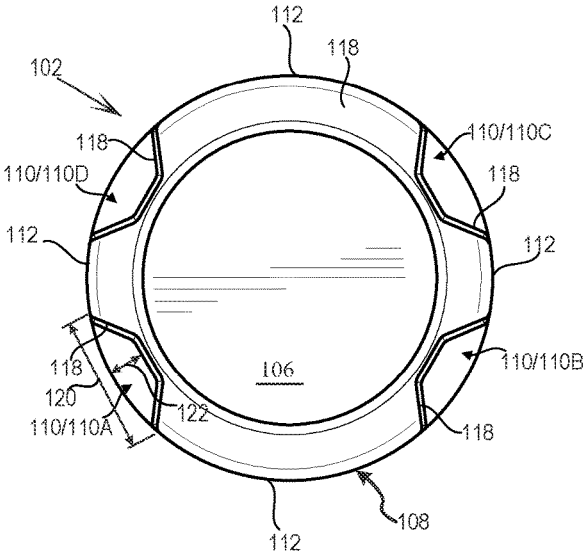
Figure 6A:
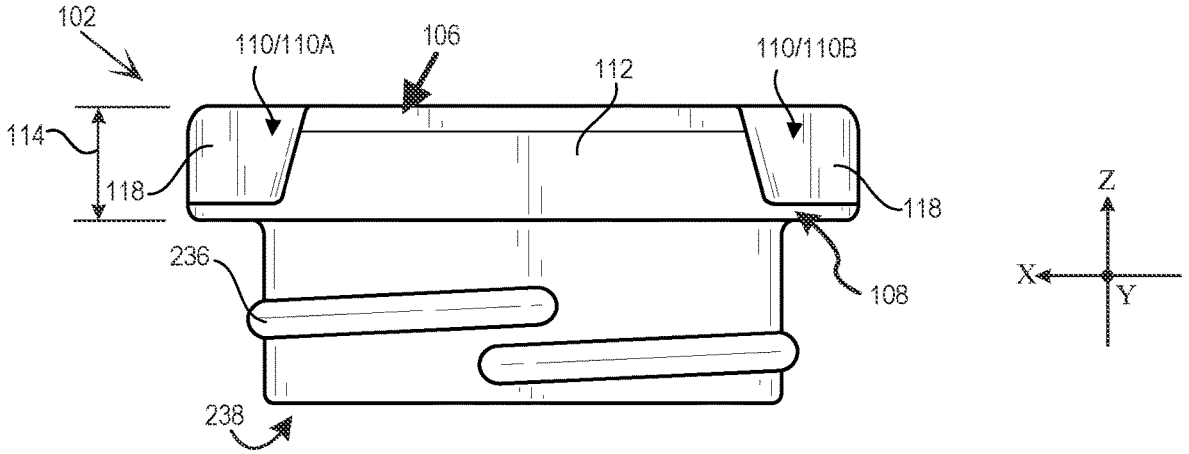
FIG. 6A is a front plane view of the screw element shown in FIG. 3 in accordance with at least one embodiment of the present invention.
Figure 6B:
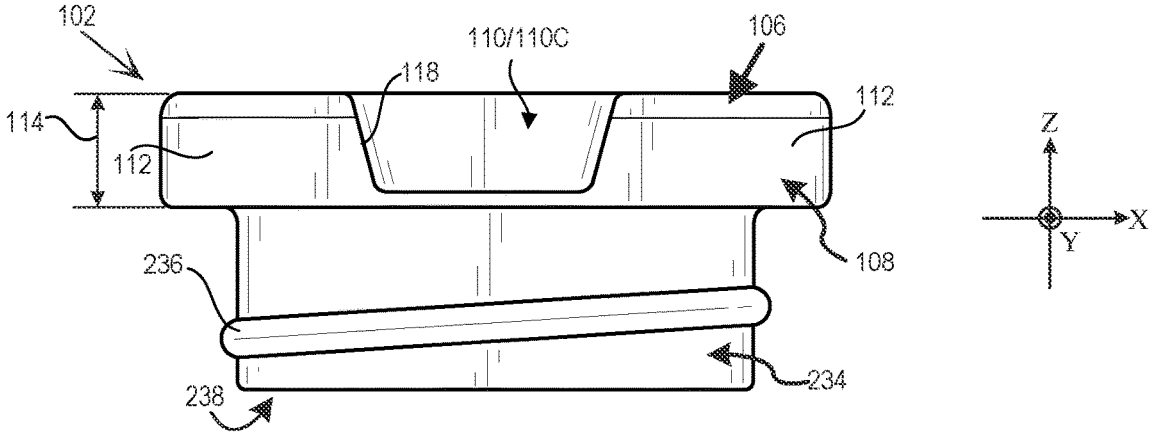
FIG. 6B is a rear plane view of the screw element shown in FIG. 3 in accordance with at least one embodiment of the present invention.
Figure 6C:
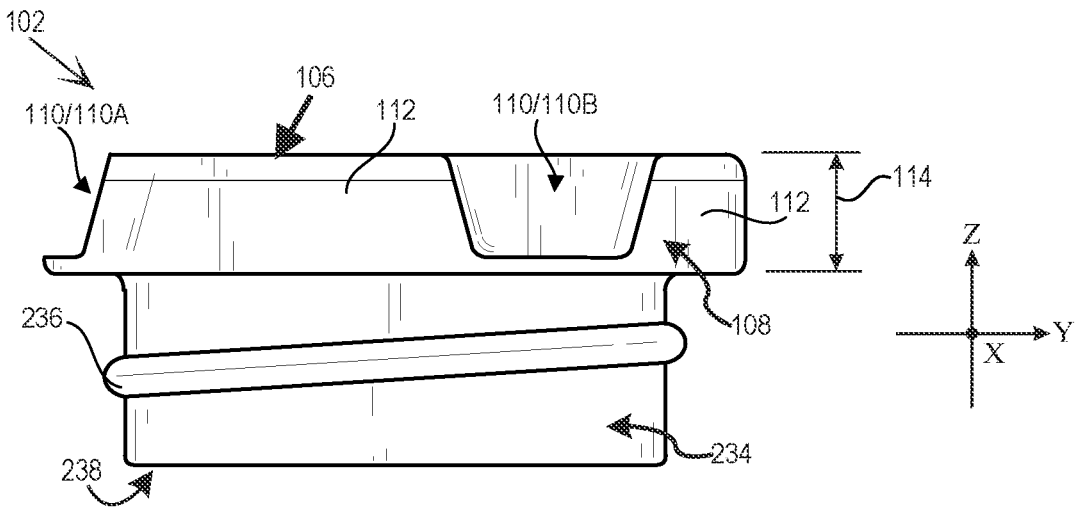
FIG. 6C is a right-side plane view of the screw element shown in FIG. 3 in accordance with at least one embodiment of the present invention.
Figure 6D:
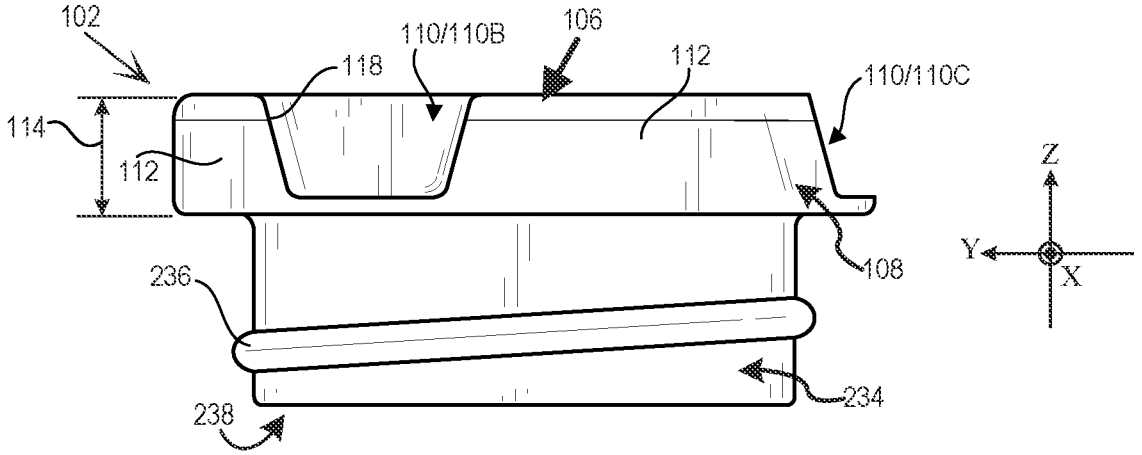
FIG. 6D is a left-side plane view of the screw element shown in FIG. 3 in accordance with at least one embodiment of the present invention.

Further, FIGS. 5A-5D further assist in appreciating that in varying embodiments, at least a third, at least half, if not a majority of the outer circumferential wall 108 is smooth if not slick. More specifically, it can be visually appreciated that in FIG. 5A, the indent 110 presents a length 120 that is but a mere fraction of the remaining outer surface of the circumferential wall 108. Even with the embodiment in FIG. 5D showing four indents 110, the combined length 120 of each indent 110 is no greater than half of the outer circumference of the circumferential wall 108. It will be further understood and appreciated, that the actual number of indents that may be provided is at least in part determined the actual diameter of a given screw element 102, such that the cumulative total of the widths 120 of each provided indent, is no more than half of an otherwise continuous circumferential wall 108.

FIG. 5E and FIG. 5F provide orientation references for side views presented in FIGS. 6A-6D of screw element 102. FIGS. 5E and 5F correlate to FIG. 5C, however in light of FIGS. 6A-6D, a similar understanding of likely views may be understood and appreciated for FIGS. 5A, 5B and 5D.

Figure 7:
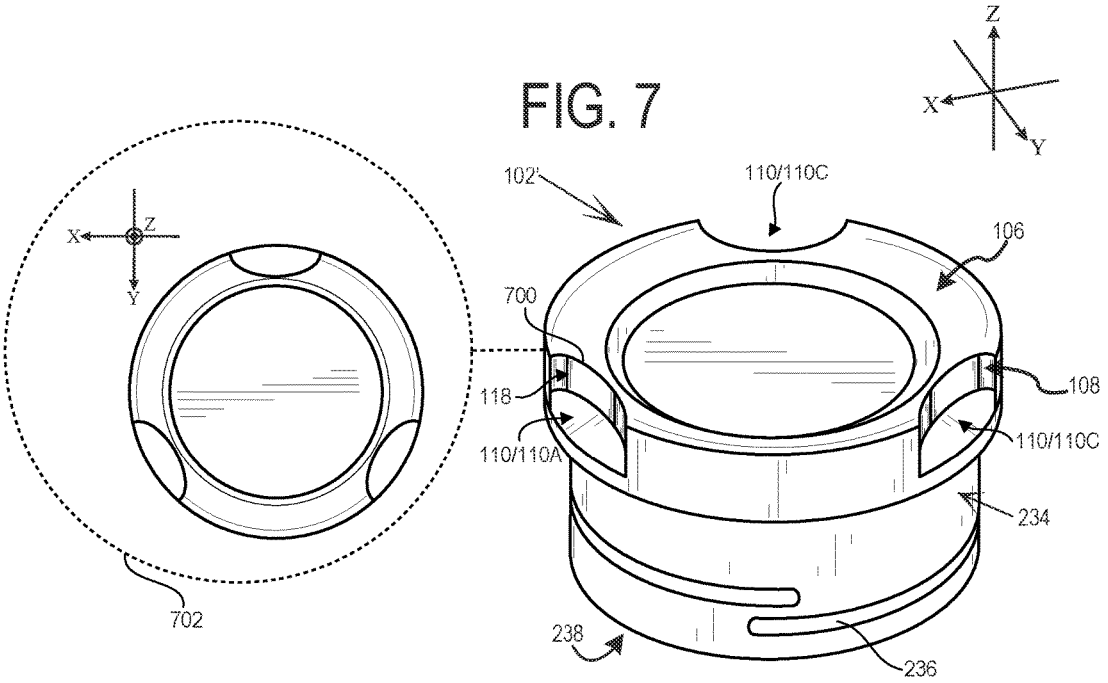
FIG. 7 is a perspective view from above of an alternative screw element for the safety container with finger grips from FIG. 1 showing curved sided indents in accordance with at least one embodiment of the present invention.
Figure 8:
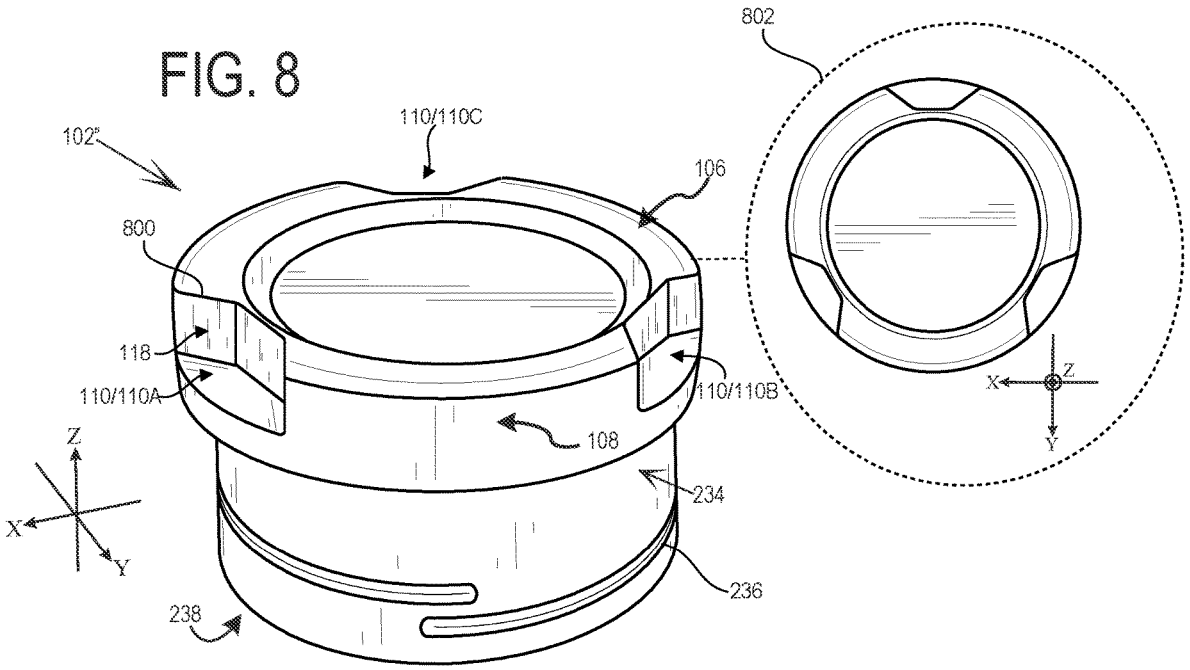
FIG. 8 is a perspective view from above of yet another alternative screw element for the safety container with finger grips from FIG. 1 showing straight sided indents in accordance with at least one embodiment of the present invention.

FIG. 7 provides a perspective view of screw element 102' in accordance with an alternative embodiment with each of the at least one indents 110 provided as curved side walls 700 as abutment surfaces 118. Dotted circle 702 provides a respective plane view of screw element 102'. Similarly, FIG. 8 provides a perspective view of screw element 102" in accordance with yet another alternative embodiment with each of the at least one indents 110 provided as straight side walls 800 as abutment surfaces 118. Dotted circle 802 provides a respective plane view of screw element 102" It will be further appreciated that yet other embodiments may provide each of the at least one indents 110 with combinations of curved and straight side wall elements. With respect to the varying embodiments of screw element 102' and 102", it will be understood and appreciated that each of the at least one indents 110 have substantially the same height, length and depth dimensions as discussed above. Moreover, each of the at least one indents 110 is structured and arranged with sufficient size and abutment surfaces to receive a user's fingertips.

Figure 9:
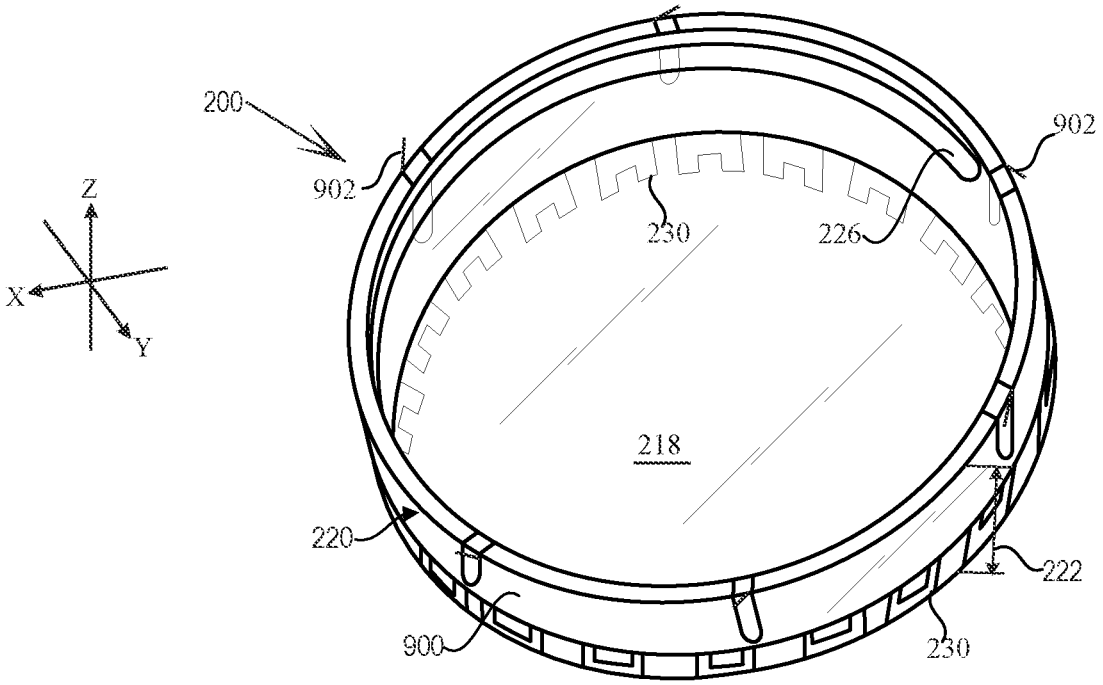
FIG. 9 is a perspective view from above of the inner body element of the safety container with finger grips from FIG. 1 in accordance with at least one embodiment of the present invention.

FIG. 9 is a perspective view into inner body 200 so as to further appreciate the second circular element 218 (e.g., top) and second grippers 230 as disposed upon the outer surface 228 of the second circular element 218. More specifically the second grippers 230 are shown in light relief as they appear under the second circular element 218, and in darker relief as they ring the perimeter edge.

Figure 10:
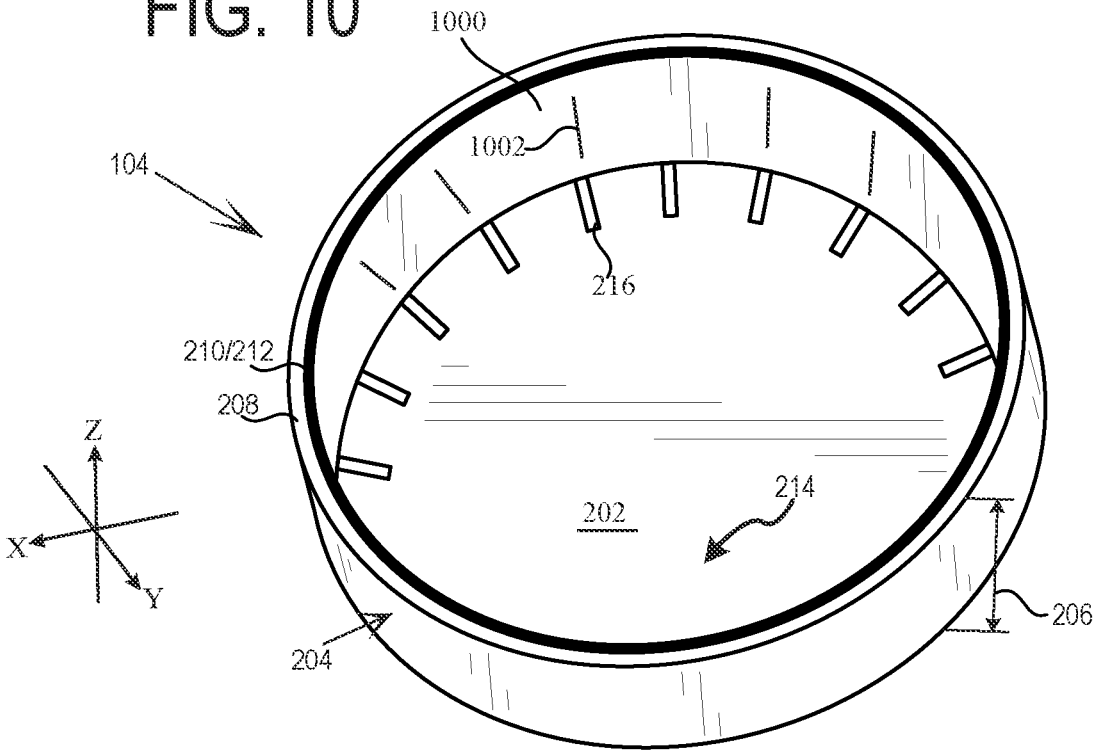
FIG. 10 is a perspective view from above of the outer body element of the safety container with finger grips from FIG. 1 in accordance with at least one embodiment of the present invention.

FIG. 10 is a perspective view into the outer body so as to further appreciate the first circular element 202 (e.g., top), the first grippers 216, and retainer 210 as an inward lip 212.

For at least one embodiment, the outer surface 900 of second circumferential wall 220 and the inner surface 1000 of first circumferential wall 108, may have optional one-way binders—elements 902 in FIG. 9, and elements 1000 in FIG. 10. These optional one-way binders may be configured as a rachet, e.g., elements 902 as spring extensions and elements 1000 as ridges. In other words, the optional one-way binders are structured and arranged to temporarily bind with each other when the screw element 102 is being actively screwed into the inner body 200 as nested within the outer body 104. Such one-way binders thereby facilitating screw coupling between the screw element 102 and the inner body 200 without requiring push and turn operation as required for the removal of the screw element 102 from the inner body 200.

With respect to SCFG 100 as herein described, it will be understood and appreciated that the screw element 102, outer body 104 and inner body 200 may be formed of glass, ceramic, polycarbonate, metal, wood, or such other durable material as may be desired for varying embodiments. Indeed, in varying embodiments one or more of the elements may be made from different materials, e.g., the screw element may be formed of ceramic material while the outer body 104 and inner body 200 are formed of plastic or polycarbonate.

With respect to the above description and accompanying figurers, it will be appreciated that for at least one embodiment, SCFG 100 may be summarized as comprising: an outer body 104 characterized by: a first circular element 202 bounded by a first circumferential wall 204 extending normally away from the first circular element 202 for a first distance 206, the distal end of the first circumferential wall 204 having an inward lip 212; an inner surface 214 of the first circular element 202 providing a plurality of first ridges; an inner body 200 characterized by: a second circular element 218 bounded by a second circumferential wall 220 extending normally away from the second circular element 218 a second distance 222 less than the first distance 206; an inner surface 214 of the second circumferential wall 220 having first threads 236; and an outer surface of the second circular element 218 having a plurality of second ridges for temporarily engaging with the first ridges of the first circular element 202; wherein the inner body 200 is structured and arranged to nest within the outer body 104 and be retained by the inward lip 212, the inner body 200 freely rotating within the outer body 104 below the lip when the first ridges are not engaged with the second ridges; and a screw element screw element characterized by: a circular first element having a substantially smooth outer circumferential wall having at least one indent 110 providing an abutment surface 118 to receive a substantial portion of a user's fingertip, the circumferential wall; and a threaded collar 234 extending normally from the circular first element below the least one indent 110, the threaded collar 234 structured and arranged to be disposed within the inner body 200 and engage the first threads 236 of the inner surface 214 of the second circumferential wall 220 to temporarily bind the screw element with the inner body 200, the threaded collar 234 defining at least a portion of a storage space for the safety container 100.

For yet another embodiment, SCFG 100 may be summarized as comprising: a first circular element 202 bounded by a first circumferential wall 204 extending normally away from the first circular element 202 for a first distance 206, the distal end of the first circumferential wall 204 having a retainer; an inner surface 214 of the first circular element 202 providing a plurality first grippers; an inner body 200 characterized by: a second circular element 218 bounded by a second circumferential wall 220 extending normally away from the second circular element 218 a second distance 222 less than the first distance 206; an inner surface 214 of the second circumferential wall 220 having a first screw threads; and an outer surface of the second circular element 218 having a plurality of second grippers for temporarily engaging with the first grippers of the first circular element 202; wherein the inner body 200 structured and arranged to nest within the outer body 104 and be retained by the retainer, the inner body 200 freely rotating within the outer body 104 below the retainer when the first grippers are not engaged with the second grippers; and a screw element characterized by: a circular first element having a substantially smooth outer circumferential wall having at least one indent 110 providing an abutment surface 118 to receive a substantial portion of a user's fingertip, the circumferential wall; and a threaded circular wall extending normally from a circular first element below the at least one indent 110*s*, the threaded collar 234 structured and arranged to be disposed within the inner body 200 and engage the first threads 236 of the inner surface 214 of the second circumferential wall 220 to temporarily bind the screw element with the inner body 200.

It will also be appreciated that the advantageous screw element 102 with finger grips for a push and turn child safety container (e.g. SCFG 100) may be summarized as comprising a circular first element having a substantially smooth outer circumferential wall having at least one indent 110 structured and arranged to receive a user's finger, the least one indent 110 providing an abutment surface 118 to receive a substantial portion of a user's fingertip, the circumferential wall sections being substantially smooth; and a threaded circular wall extending normally from a circular first element below the least one indent 110, the threaded collar 234 structured and arranged to be disposed within the inner body 200 and engage the first threads 236 of the inner surface 214 of the second circumferential wall 220 to temporarily bind the screw element with the inner body 200, the threaded collar 234 defining at least a portion of a storage space for the safety container 100.

Changes may be made in the above methods, systems and structures without departing from the scope hereof. It should thus be noted that the matter contained in the above description and/or shown in the accompanying drawings should be interpreted as illustrative and not in a limiting sense. Indeed, many other embodiments are feasible and possible, as will be evident to one of ordinary skill in the art. The claims that follow are not limited by or to the embodiments discussed herein, but are limited solely by their terms and the Doctrine of Equivalents.

What is claimed:

1. A push and turn child safety container comprising:

an outer body characterized by:

a first circular element bounded by a first circumferential wall extending normally away from the first circular element for a first distance, the distal end of the first circumferential wall having an inward lip;

an inner surface of the first circular element providing a plurality of first ridges;

an inner body characterized by:

a second circular element bounded by a second circumferential wall extending normally away from the second circular element a second distance less than the first distance;

an inner surface of the second circumferential wall having first threads; and an outer surface of the second circular element having a plurality of second ridges for temporarily engaging with the first ridges of the first circular element;

wherein the inner body is structured and arranged to nest within the outer body and be retained by the inward lip, the inner body freely rotating within the outer body below the lip when the first ridges are not engaged with the second ridges; and a screw element screw element characterized by:

a circular first element having a substantially smooth outer circumferential wall having at least one indent providing an abutment surface to receive a substantial portion of a user's fingertip, the circumferential wall; and a threaded collar extending normally from the circular first element below the least one indent, the threaded collar structured and arranged to be disposed within the inner body and engage the first threads of the inner surface of the second circumferential wall to temporarily bind the screw element with the inner body, the threaded collar defining at least a portion of a storage space for the safety container.

2. The child safety container of claim 1, wherein the substantially smooth outer circumferential wall is substantially slick.

3. The child safety container of claim 1, wherein there a plurality of indents.

4. The child safety container of claim 3, wherein there are a plurality of indents and a plurality of circumferential wall sections each having a length between the indents, the substantially smooth outer circumferential wall having a circumference the collective length of the plurality of wall sections being not less than one-third of the circumference.

5. The child safety container of claim 3, wherein there are a plurality of indents and a plurality of circumferential wall sections each having a length between the indents, the substantially smooth outer circumferential wall having a circumference the collective length of the plurality of wall sections being not less than one-half of the circumference.

6. The child safety container of claim 1, wherein each indent has a length of between about 1 centimeter and 2 centimeters, a depth of between about 0.25 centimeters and 0.75 centimeters, and a height of between about 0.25 centimeters and 0.75 centimeters.

7. The child safety container of claim 1, further including a spring disposed between the inner body and the outer body, the spring biased to separate the first ridges and second ridges.

8. A push and turn child safety container comprising:

an outer body characterized by:

a first circular element bounded by a first circumferential wall extending normally away from the first circular element for a first distance, the distal end of the first circumferential wall having a retainer;

an inner surface of the first circular element providing a plurality first grippers;

an inner body characterized by:

a second circular element bounded by a second circumferential wall extending normally away from the second circular element a second distance less than the first distance;

an inner surface of the second circumferential wall having a first screw threads; and an outer surface of the second circular element having a plurality of second grippers for temporarily engaging with the first grippers of the first circular element;

wherein the inner body structured and arranged to nest within the outer body and be retained by the retainer, the inner body freely rotating within the outer body below the retainer when the first grippers are not engaged with the second grippers; and a screw element characterized by:

a circular first element having a substantially smooth outer circumferential wall having at least one indent providing an abutment surface to receive a substantial portion of a user's fingertip, the circumferential wall; and a threaded circular wall extending normally from a circular first element below the at least one indents, the threaded collar structured and arranged to be disposed within the inner body and engage the first threads of the inner surface of the second circumferential wall to temporarily bind the screw element with the inner body.

9. The child safety container of claim 8, wherein the substantially smooth outer circumferential wall is substantially slick.

10. The child safety container of claim 8, wherein there are at least two indents.

11. The child safety container of claim 8, wherein there are a plurality of indents and a plurality of circumferential wall sections each having a length between the indents, the substantially smooth outer circumferential wall having a circumference the collective length of the plurality of wall sections being not less than one-third of the circumference.

12. The child safety container of claim 8, wherein there are a plurality of indents and a plurality of circumferential wall sections each having a length between the indents, the substantially smooth outer circumferential wall having a circumference the collective length of the plurality of wall sections being not less than one-half of the circumference.

13. The child safety container of claim 8, wherein each indent has a length of between about 1 centimeter and 2 centimeters, a depth of between about 0.25 centimeters and 0.75 centimeters, and a height of between about 0.25 centimeters and 0.75 centimeters.

14. The child safety container of claim 8, further including a spring disposed between the inner body and the outer body, the spring biased to separate the first ridges and second ridges.

15. A screw element with finger grips for a push and turn child safety container having an outer body having a first circular element bounded by a first circumferential wall extending normally away from the first circular element for a first distance, the distal end of the first outer wall having a retainer with an inner body having a second circular element bounded by a second circumferential wall extending normally away from the second circular element a second distance less than the first distance with an inner surface of the second circumferential wall having a first screw thread, the inner body nested with in the outer body and retained by the retainer, comprising:

a screw element characterized by:

a circular first element having a substantially smooth outer circumferential wall having at least one indent structured and arranged to receive a user's finger, the least one indent providing an abutment surface to receive a substantial portion of a user's fingertip, the circumferential wall sections being substantially smooth; and a threaded circular wall extending normally from a circular first element below the least one indent, the threaded collar structured and arranged to be disposed within the inner body and engage the first threads of the inner surface of the second circumferential wall to temporarily bind the screw element with the inner body, the threaded collar defining at least a portion of a storage space for the safety container.

16. The screw element for a push and turn child safety container of claim 15, wherein the substantially smooth outer circumferential wall is substantially slick.

17. The screw element for a push and turn child safety container of claim 15, wherein there are a plurality of indents and a plurality of circumferential wall sections each having a length between the indents, the out substantially smooth outer er circumferential wall having a circumference the collective length of the plurality of wall sections being not less than one-third of the circumference.

18. The screw element for a push and turn child safety container of claim 15, wherein there are a plurality of indents and a plurality of circumferential wall sections each having a length between the indents, the substantially smooth outer circumferential wall having a circumference the collective length of the plurality of wall sections being not less than one-half of the circumference.

19. The screw element for a push and turn child safety container of claim 15, wherein each of the plurality of indents has a length of between about 1 centimeter and 2 centimeters, a depth of between about 0.25 centimeters and 0.75 centimeters, and a height of between about 0.25 centimeters and 0.75 centimeters.

20. The screw element for a push and turn child safety container of claim 15, wherein the threaded collar defines at least a portion of a storage space for the safety container.

* * * * *